US007812236B1

(12) United States Patent
Good

(10) Patent No.: US 7,812,236 B1
(45) Date of Patent: Oct. 12, 2010

(54) ONE-PIECE WOODEN DRUM SHELL FORMATION

(75) Inventor: John J. Good, Thousand Oaks, CA (US)

(73) Assignee: Drum Workshop, Inc., Oxnard, CA (US)

( * ) Notice: Subject to any disclaimer, the term of this patent is extended or adjusted under 35 U.S.C. 154(b) by 0 days.

(21) Appl. No.: 12/455,770

(22) Filed: Jul. 13, 2009

(51) Int. Cl.
*G10D 13/02* (2006.01)

(52) U.S. Cl. ..... 84/411 R

(58) Field of Classification Search ..... 84/411 R
See application file for complete search history.

(56) References Cited

U.S. PATENT DOCUMENTS

| | | | | |
|---|---|---|---|---|
| 2,115,741 | A * | 5/1938 | Newberry | 84/411 R |
| RE26,415 | E * | 6/1968 | Ludwig | 84/411 R |
| 5,377,576 | A * | 1/1995 | Good et al. | 84/411 R |
| 5,404,785 | A * | 4/1995 | Belli | 84/411 R |
| 5,517,890 | A * | 5/1996 | Cooperman | 84/411 R |
| 5,587,544 | A * | 12/1996 | Fujii et al. | 84/411 R |
| 6,380,468 | B1 | 4/2002 | Shigenaga | |
| 6,525,250 | B2 * | 2/2003 | Goods | 84/411 R |
| 7,692,082 | B2 * | 4/2010 | Abe | 84/411 R |
| 7,718,876 | B1 * | 5/2010 | Good | 84/411 R |
| 7,723,594 | B2 * | 5/2010 | Hong | 84/412 |
| 2002/0178894 | A1 * | 12/2002 | Goods | 84/411 R |
| 2006/0016319 | A1 * | 1/2006 | Ito | 84/411 R |
| 2006/0230912 | A1 | 10/2006 | Pickens | |
| 2006/0249005 | A1 | 11/2006 | Rush | |
| 2009/0019985 | A1 * | 1/2009 | Casanta | 84/411 R |
| 2009/0173209 | A1 * | 7/2009 | Abe et al. | 84/411 R |

OTHER PUBLICATIONS

Earliest drum 1300 AD from hollow trees viewed Feb. 8, 2009 at http://www.medieval-life-and-times.info/medieval-music/drum.htm.*

Brady Drum by Chris Brady made one piece shell in 1980, viewed Feb. 8, 2010 at http://www.bradydrums.com.au/history.html; http://www.bradydrums.com.au/solid.html and http://www.bradydrums.com.au/solid-drum-making.html.*

Mattingly, Rick Canopus Zelkova Snare Drums, Modern Drummer, Sep. 2000, drum shells are made from bored out section of a tree trunk, milled and drum heads are added, viewed Feb. 8, 2010 at http://www.canopusdrums.com/english/html/review/md_review-e.html.*

How to Build a Wooden Drum, eHow.com contributing writer, viewed Feb. 8, 2010 at http://www.ehow.com/how_4794648_build-wooden-drum.html.*

Drum Shells Explained to Find a Perfect Drum Shell, © 2004-2010, http://www.drumjunction.com/drum_shells.html viewed on Jun. 14, 2010.*

* cited by examiner

*Primary Examiner*—Jeffrey Donels
*Assistant Examiner*—Robert W Horn
(74) *Attorney, Agent, or Firm*—William W. Haefliger

(57) ABSTRACT

In the method of producing a drum having a desired tonal quality, including providing a one-piece wooden cylindrical shell, milling the shell bore to reduce shell thickness to a level characterized as associated with a selected drum tone preliminarily produced when the assembled drum having a head or heads is struck with a beater, and tensioning the head or heads to achieve final tonality.

8 Claims, 4 Drawing Sheets

ONE-PIECE WOODEN DRUM SHELL FORMATION

This invention claims priority from provisional application Ser. No. 61/131,503, filed Jun. 11, 2008.

BACKGROUND OF THE INVENTION

This invention relates generally to formation of drum shells to produce selected tonal characteristics, and more particularly to formation of one-piece wooden shells having such characteristics.

In the past, thin layers or sheets of wood were deformed and assembled in a drum shell configuration, with adhesive applied between the multi-ply layers to adhere them and form a shell. This method of production and assembly is time consuming and results in a shell with multiple layers of adhesive between the layers, and at times adversely affecting the resultant shell sound or tone when assembled onto drum heads struck by a beater. There is need for improvements in drum shell production.

SUMMARY OF THE INVENTION

The present invention in its method and apparatus aspects, provides for formation of a unitary, one-piece, wooden shell of selected wall thickness eliminating need to assemble multiple wooden plies, adhered by glue or adhesive in overlapping relation.

It is a major object of the invention to provide a method for producing a drum having superior tonality, and that includes the steps:

a) providing a one-piece wooden cylindrical shell, b) milling the shell bore to reduce shell thickness to a level characterized as associated with a selected drum tone preliminarily produced when the assembled drum having a head or heads is struck with a beater, c) and tensioning the head or heads to achieve final tonality.

Another object includes forming tapered annular shell ends by removing wood from the shell at said ends, thereby to maintain shell one-piece integrity. Typically, such taper extends at the inner side of the shell end; and milling is about 1 inch.

Yet another object includes formation of a one-piece shell with tapered undercut ends, the shell uniform thickness between such ends being less than about 1 inch.

These and other objects and advantages of the invention, as well as the details of an illustrative embodiment, will be more fully understood from the following specification and drawings, in which:

DRAWING DESCRIPTION

FIG. 1 is an end view of a wooden cylinder prior to its formation into a tapered end shell;

FIG. 1*a* is an enlarged section taken on lines 1*a*-1*a* of FIG. 1;

DETAILED DESCRIPTION

Figure 1:
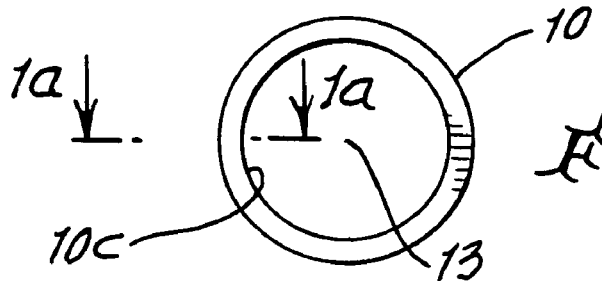
Figure 1A:
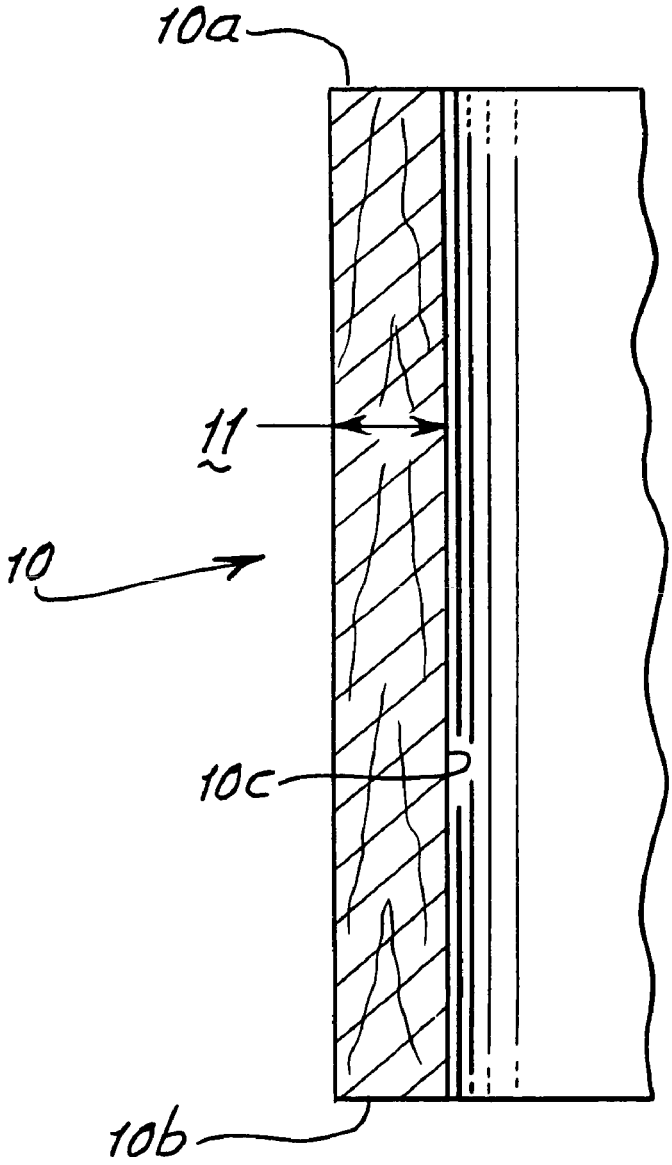

FIG. 1 is an end view of a wooden cylinder 10 to be formed into a drum shell. FIG. 1*a* shows the cylinder 10 to have wall thickness 11, typically uniform along the axial length of the wooden cylinder between its opposite ends 10*a* and 10*b*.

Figure 2:
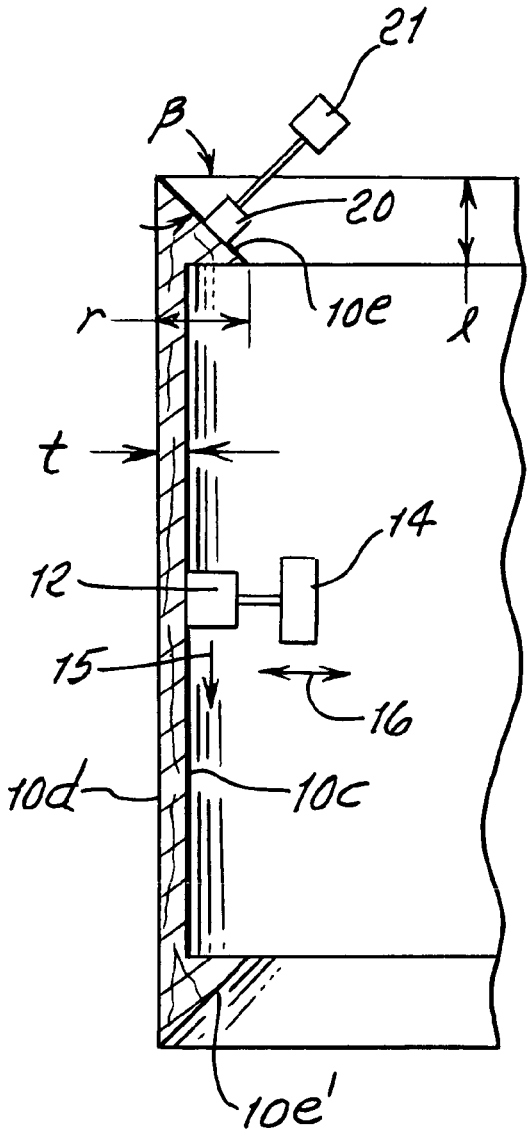
FIG. 2 is an enlarged axial section taken through the shell wall.

The shell bore 10*c* is then milled, as by use of rotary cutter 12, driven in rotation about the shell axis 13, the drive schematically indicated at 14 in FIG. 2. The drive may for example not only rotate the cutter about axis 13, but also advance it axially (see arrows 15) and radially (see arrows 16) thereby to remove wood at the bore 10*c*, reducing the wall to a selected thickness "t", as measured between the bore and the outer cylindrical wall 10*d* of the shell. The diameter of that wall defines the resultant drum diameter. Another cutter 20, driven at 21, may be employed to form an end wall taper 10*e* of axial length "1", and wall radial dimension "r". The angularity β of that taper is preferably 45°. A similarly tapered opposite end wall is formed at 10*e'*.

Selected wall thickness t, between the tapered ends 10*e* and 10*e'* is: ⅞ inch; ¾ inch; ½ inch; and ⅜ inch. Starting thickness, before cutting, may be about 1 inch. The resultant drum, when struck, has a predictable and different tone when struck by a beater, for each of the wall thicknesses, and uncontrollable variability of tone, characteristic of a multiple ply drum shell with glued together plies, affecting wall thickness, is eliminated.

Figure 3:
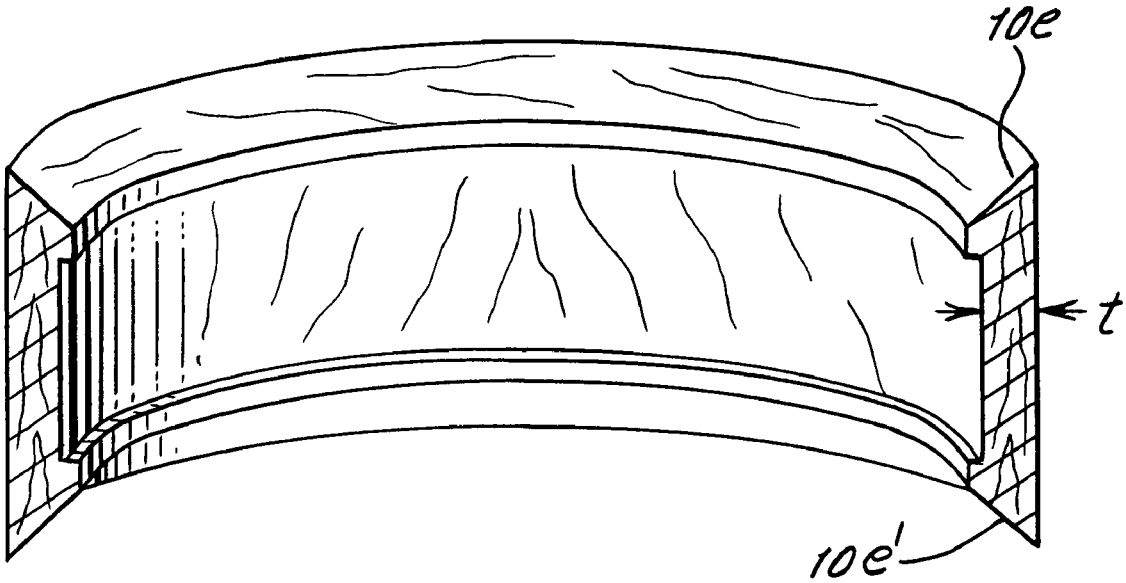
FIGS. 3-6 are perspective views of different tapered and unitary drum walls.
Figure 4:
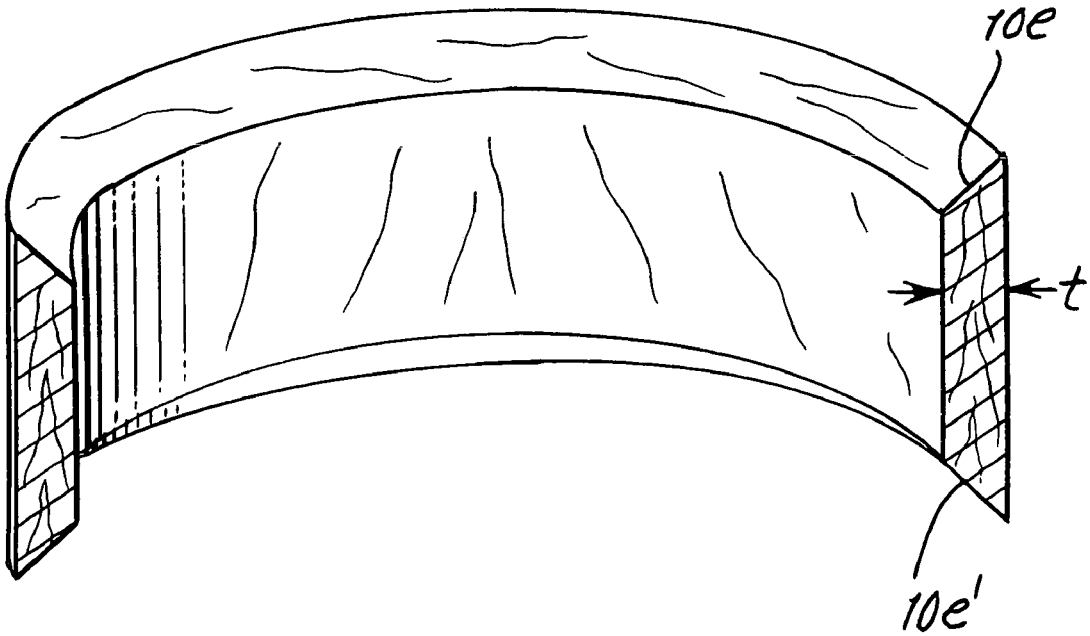
Figure 5:
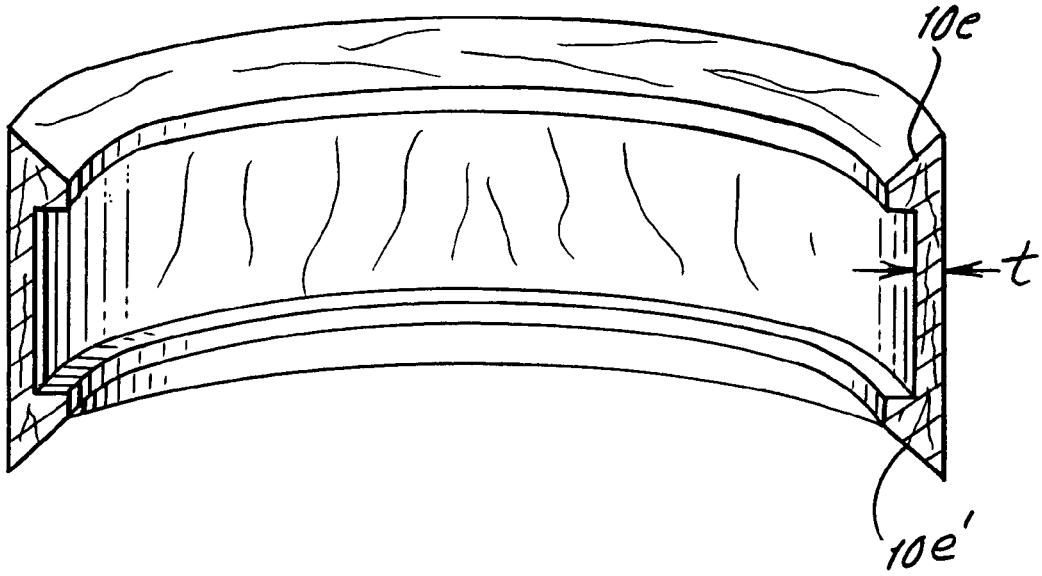
Figure 6:
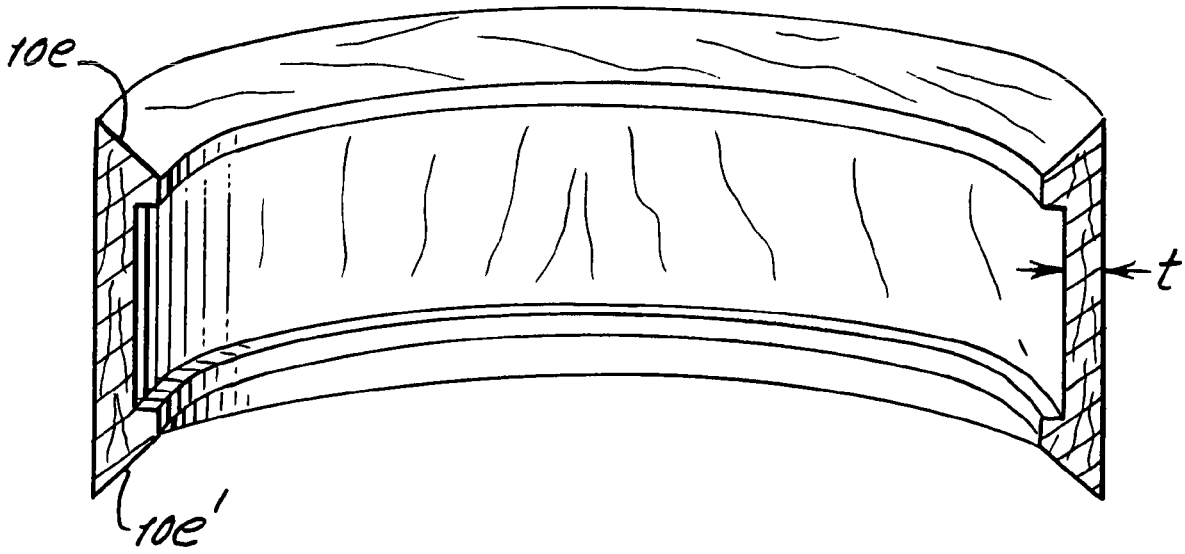

FIGS. 3, 4, 5 and 6 are sections taken through resultant shells, of different wall thickness, and with tapered ends. In FIGS. 3, 5 and 6, the tapered shell ends overhang the milled bores. In these views, the shell has tapered annular opposite ends, such taper extending at the inner sides of said ends. In FIG. 4 the shell bore underlies the taper innermost edges.

Figure 7:
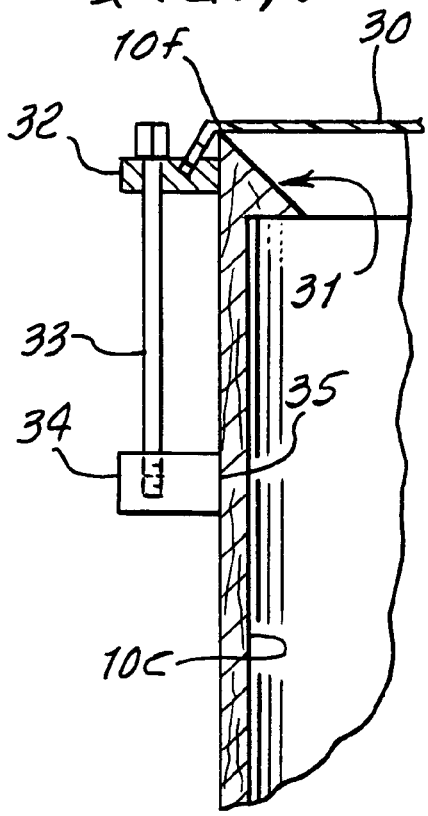
FIG. 7 is a view like FIG. 2.

FIG. 7 is a fragmentary section showing a drum head 30, typically plastic, stretched over the rim 10*f* of the one-piece wooden shell tapered end 31, and connected to a ring 32, which is adjustably displaced downwardly by rod 33 toward a threaded lug 34 attached at 35 to the shell exterior surface. Such adjusted displacement and drum head tensioning, combined with selected unitary wall thickness achieves sought after superior tonality.

Usable woods include oak, maple, birch and ash. Others are also usable.

What is claimed is:

1. In the method of producing a drum having a desired tonal quality, the steps that include:

a) providing a one-piece wooden cylindrical shell, b) milling the shell bore to reduce shell thickness to a level characterized as associated with a selected drum tone preliminarily produced when the assembled drum having a head or heads is struck with a beater, c) forming tapered annular shell ends by removing wood from the shell at said ends, thereby to maintain shell one-piece integrity, said tapers extending at the inner sides of the shell ends, d) said milling of the bore extends into underlying relation to said taper, thereby to maintain the one-piece wooden integrity of the shell, e) and tensioning the head or heads to achieve final tonality.

2. The method of claim 1 wherein produced shell wall thickness is one of the following:

i) ⅞ inch, ii) ¾ inch, iii) ½ inch, iv) ⅜ inch.

3. The method of claim 2 wherein the shell thickness prior to said milling is about 1 inch.

4. The drum shell formed by the method of claim 1.

5. The drum shell formed by the method of claim 2.

6. The drum shell formed by the method of claim 3.

7. The method of claim 1 wherein the shell bore is formed to be characterized by one of the following:

i) underlying said tapered ends, which overhang said bore, ii) underlying the innermost edges of said tapers.

8. The method of claim 1 wherein the shell bore is formed to be uniform between said ends, and shell wall thickness is less than about 1 inch, between said tapered ends.

* * * * *